United States Patent [19]

Meister

[11] Patent Number: 4,930,304

[45] Date of Patent: Jun. 5, 1990

[54] BRACELET WITH LINKS

[75] Inventor: Leonhard Meister, Selzach, Switzerland

[73] Assignee: Montres Rado S.A., Lengnau, Switzerland

[21] Appl. No.: 370,721

[22] Filed: Jun. 23, 1989

[30] Foreign Application Priority Data

Jun. 24, 1988 [FR] France ..... 88 08630

[51] Int. Cl.[5] ..... F16G 13/08

[52] U.S. Cl. ..... 59/80; 59/901; 63/4

[58] Field of Search ..... 59/78, 80, 901, 79.1, 59/79.3; 63/4, 3

[56] References Cited

U.S. PATENT DOCUMENTS

| | | | |
|---|---|---|---|
| 1,283,883 | 11/1918 | Palk | 59/80 |
| 1,598,250 | 8/1926 | Person | 59/80 |
| 2,421,720 | 6/1947 | Singer | 59/80 |
| 3,203,200 | 8/1965 | Zenichi | 59/79.1 |
| 3,940,038 | 2/1976 | Claude | 59/79.1 |
| 4,458,478 | 7/1984 | North | 59/79.3 |
| 4,840,044 | 6/1989 | Scholpp | 59/80 |

FOREIGN PATENT DOCUMENTS

| | | | |
|---|---|---|---|
| 0030705 | 6/1981 | European Pat. Off. | 59/80 |
| 91828 | 8/1968 | France . | |
| 563741 | 7/1975 | Switzerland . | |
| 593032 | 11/1977 | Switzerland . | |
| 0630789 | 7/1982 | Switzerland | 59/80 |

*Primary Examiner*—David Jones

*Attorney, Agent, or Firm*—Griffin, Branigan & Butler

[57] ABSTRACT

The bracelet of this invention includes an inner chain (1) formed from links (2,3) articulated in succession to one another by means of connecting pins (10). The chain is at least partially surrounded by decorative elements (11) formed for example of ceramic. The connecting pins exhibit projections (19, 20) from both lateral sides (13,14) of the inner chain and serve as retaining means for the decorative elements on the inner chain. In one embodiment of the invention the pin projections penetrate into slideways (17, 18) formed in the lateral portions (15,16) of the decorative element. Such bracelet is intended for horological applications.

8 Claims, 2 Drawing Sheets

BRACELET WITH LINKS

This invention concerns a bracelet including an inner chain formed of articulated links, each link being coupled to the adjacent link by a hinged assembly arrangement including the interlacing of projections borne by the transversal edges of two adjacent links, said projections being provided with respective holes traversed by a pin so as to connect pivotally said links successively to one another and a plurality of decorative elements arranged side by side and at least partially surrounding said inner chain.

BACKGROUND OF THE INVENTION

The patent document CH-A-600 815 (GB-A-1 495 853) has already disclosed a bracelet corresponding to the generic definition just given hereinabove. Such bracelet is characterized in that it is formed of an inner chain including links pivotally connected by pins and an equal number of external ornamental elements covering said links The cited construction at the same time exhibits the difficulty of means for fastening the internal links to the external elements which consist either in chasing the extreme portions of the external elements onto the inner chain (setting), or welding or brazing the external elements onto the internal links These means require lengthy and costly operations.

To overcome the difficulty as mentioned, the patent document FR-A-2 502 916 proposes a bracelet formed from an inner chain onto which may be slid the decorative elements provided with retaining slideways and in which may slide the links composing the inner chain. This construction however requires a special form for the links and such form calls for a complicated and thus costly machining operation.

SUMMARY OF THE INVENTION

To overcome the difficulties listed hereinabove, the present invention is characterized in that the connecting pins for the links project from the two lateral sides of the inner chain in order to serve as retaining means of said decorative elements on the inner chain.

Thus, one of the prime purposes of the invention is to employ the articulation pins for the links of the inner chain simultaneously as hinges and as fastening means for the decorative elements onto the said inner chain.

The invention will be better understood in the light of the description to follow and for better understanding of which reference will be made by way of example to the attached drawings.

DESCRIPTION OF THE PREFERRED EMBODIMENTS

Figure 1:
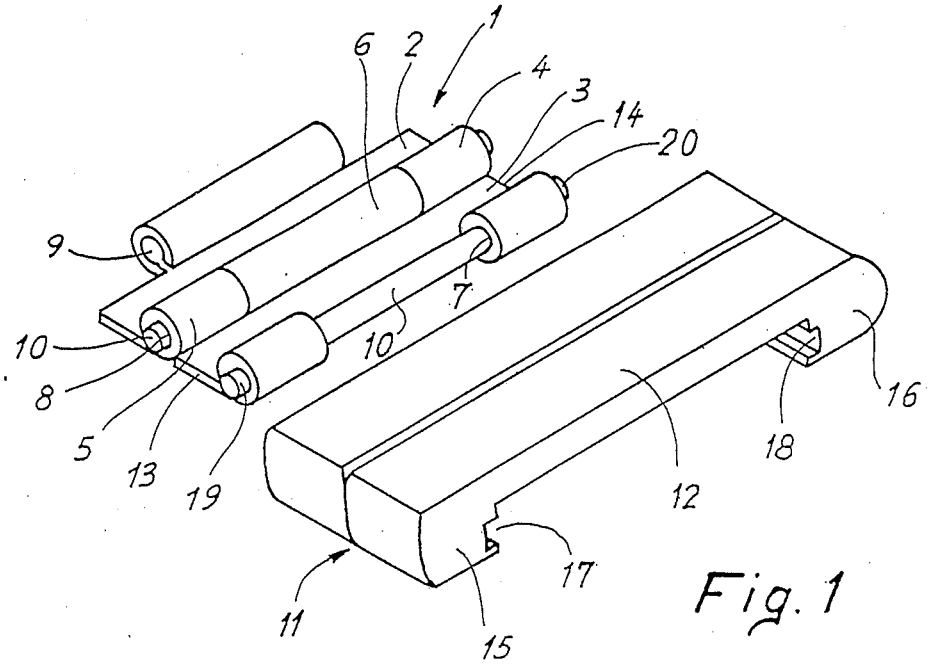
FIG. 1 is an exploded perspective view of the bracelet according to a first embodiment of the invention.
Figure 2A:
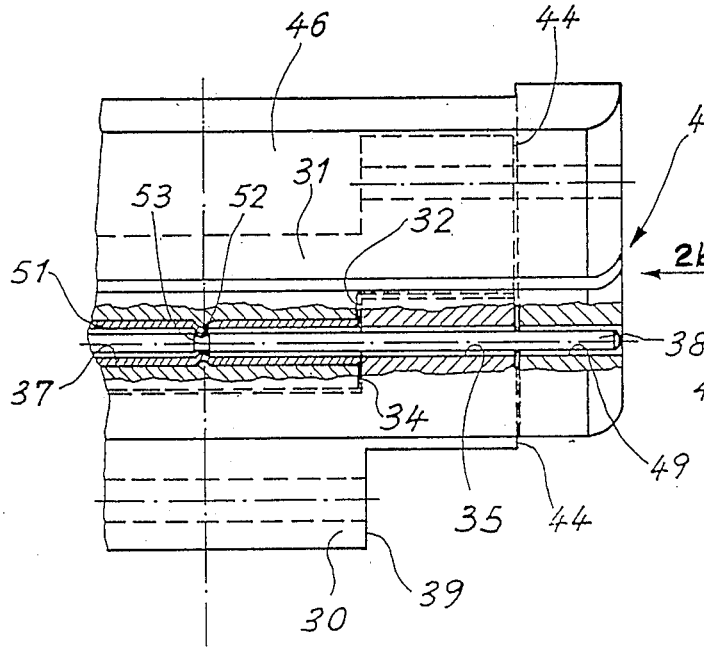
FIG. 2*a* is a top view with partial cross-section of the bracelet according to a second embodiment of the invention and which shows the bracelet assembled and composed of inner links and decorative elements covering the inner links.
Figure 2B:
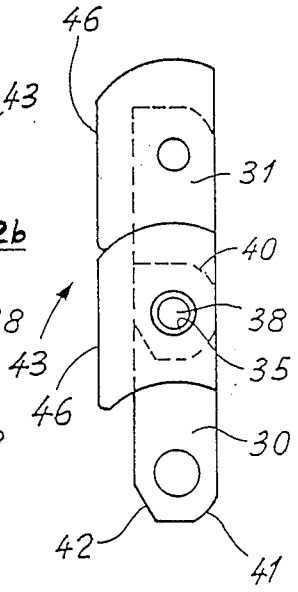
FIG. 2*b* is a view according to arrow II*b* of FIG. 2*a;*
Figure 3A:
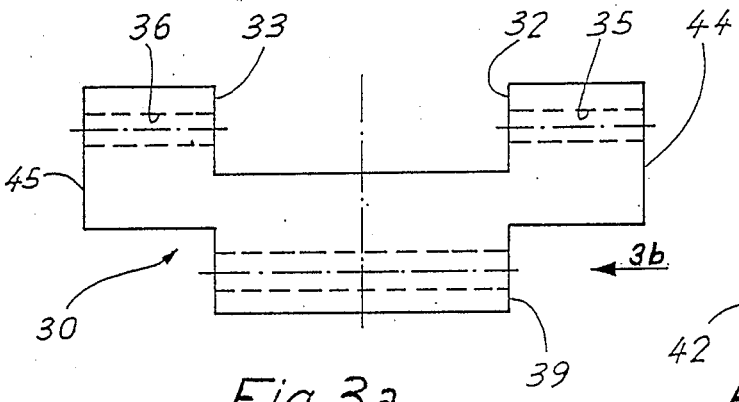
FIG. 3*a* is a top view of an inner link forming the bracelet of FIG. 2*a;*
Figure 3B:
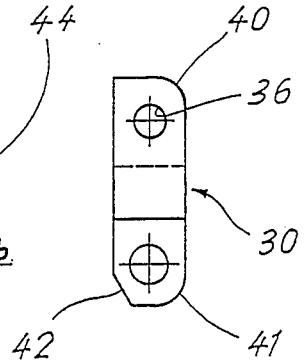
FIG. 3*b* is a view along arrow III*b* of FIG. 3*a;*
Figure 4A:
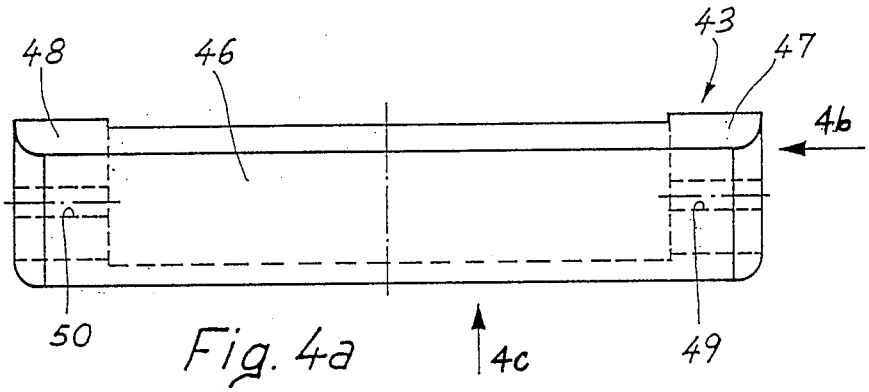
FIG. 4*a* is a top view of a decorative element forming the bracelet of FIG. 2*a;*
Figure 4C:
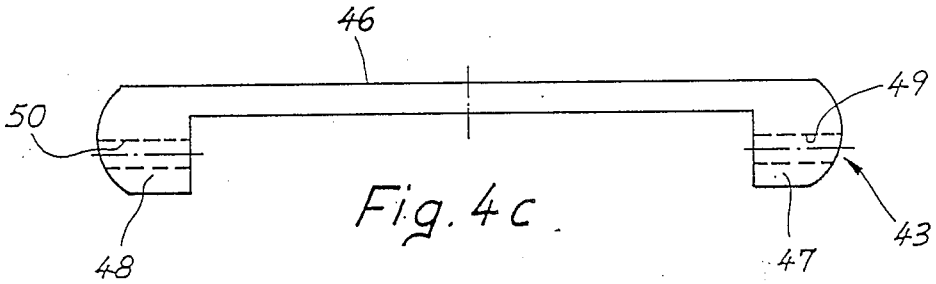
FIG. 4*c* is a view along arrow IV*c* of FIG. 4*a.*
Figure 4B:
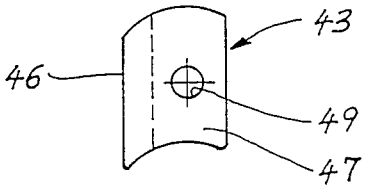
FIG. 4*b* is a view along arrow IV*b* of FIG. 4*a;*

FIG. 1 shows in perspective a first embodiment of the invention. According to the generic definition given hereinabove, this bracelet includes an inner chain 1 comprising articulated links 2, 3. Link 2 is coupled to link 3 by a hinged assembly arrangement including in the case of the example shown on FIG. 1, the interlacing of projections 4 and 5 borne by the transversal edge of link 2 with the projection 6 borne by the transversal edge of the adjacent link 3. By transversal edge here there is to be understood the interior sides of the link which are perpendicular to the longitudinal direction of the bracelet. Each of the projections 4, 5 and 6 is provided with a hole respectively referenced 7, 8 and 9. These holes are traversed by a pin 10 in a manner such that the links are pivotally connected successively to one another. FIG. 1 further shows that the bracelet includes a plurality of decorative elements 11 arranged side by side and at least partially surrounding the inner chain 1 when the chain is assembled with such elements.

As is well shown on FIG. 1, this invention is characterized in that the pins 10 project from both lateral sides 13 and 14 of chain 1 and serve as retaining means for the decorative elements 11 on the inner chain 1.

Generally, the decorative element 11 includes an upper portion 12 which extends entirely over the inner chain 1 and two lateral portions 15 and 16 which cover respectively the lateral sides 13 and 14 of the chain. In the particular example of FIG. 1 each lateral portion 15, 16 is provided with a slideway 17, 18, in which may penetrate one of the ends 19, 20 of the pin 10 projecting from the links forming the inner chain. To obtain this embodiment one may begin by assembling the inner chain to the desired length, then the decorative elements may be strung one after another onto such chain.

In the embodiment shown, the links composing the inner chain are formed from a flat metallic strip which is stamped out and the transversal projections of which are rolled so as to form knuckles into which may be introduced the pins. Such a chain is known in itself from Swiss patent document CH-A-392 958 and exhibits the advantage of being adapted to automatic production in large series and relatively inexpensively. However, in order to improve the appearance, this invention proposes to cover it over with decorative elements The inner chain then serves as a support for such decorative elements at the same time remaining easy to manufacture, the single modification necessary to such chain being that of increasing the length of the pins in order to permit the hooking of said decorative elements onto the chain.

In this embodiment it is not necessary to provide a fastening means for preventing the pins 10 from coming out of the knuckles 4, 5 and 6, such pins being maintained in place by the grooves in the decorative elements. However, in order to simplify the assembly, one may envisage clamping the pin for instance in hole 9 of the knuckle 6.

This first embodiment is not limited to the utilization of a chain having rolled links but may comprise links formed as subsequently described with reference to the second embodiment of the invention. The interest in the first embodiment resides above all in the system of slideways exhibited by the decorative element The decorative element 11 may be manufactured in the most diversified materials. Here preference has been given to a ceramic element which has a rich appearance and which may be sintered to sufficiently close tolerances so that it is unnecessary to retouch it other than by a polishing operation. It will be noted here that the traction exerted on the bracelet is borne uniquely by the inner chain and that the decorative elements do not undergo such traction. This is advantageous in the case of the utilization of a ceramic not adapted or poorly adapted to withstand such a stress. It is nonetheless possible that other materials could be employed such as hard metal or simply steel or again an alternating sequence of elements exhibiting different colours.

All the figures following FIG. 1 illustrate the second embodiment of the invention which will now be explained in detail.

FIG. *2a* is a view from above partially broken off of the bracelet according to the second embodiment. Here there is found as in the first embodiment an inner chain comprised of articulated links 30, 31. Link 30 is coupled to link 31 by a hinged assembly arrangement including the interleaving of projections 32 and 33 borne by the transversal edge of link 30 (see also FIG. *3a*) with projection 34 borne by the transversal edge of the adjacent link 31. Each of the projections 32, 33 and 34 is provided with a hole respectively referenced 35, 36 and 37 (see also FIG. *3a*). These holes are traversed by a pin 38 in a manner such that the links are pivotally connected successively to one another.

One of the links forming the inner chain is shown from above on FIG. *3a* and seen from the side on FIG. *3b* (seen according to arrow III*b* of FIG. *3a*). Here one is no longer concerned with rolled links as in FIG. 1, but with links forged from a solid mass in a single operation or machined from a solid mass to the transversal projections, these projections being pierced with a hole in order to receive the pin. FIG. *3b* shows that the projections 32, 33 and 39 bear rounded portions 40 and 41 respectively, such rounded portions permitting the inner chain to be wrapped around the wrist. The projection 39 furthermore bears a flattened portion 42 which prevents folding the chain beyond a certain limit. The function of the flattened and rounded portions will appear more clearly through examination of FIG. *2b* which is a view along arrow II*b* of FIG. *2a*. The inner chain may be formed of metal, of plastic material or eventually a metal covered with plastic material.

FIGS. *2a* and *2b* further show that the bracelet includes a plurality of decorative elements 43 arranged side by side and which surround, at least partially, the inner chain. As has already been said, this invention is characterized in that the pins 38 project from the two lateral sides 44 and 45 of the inner chain and serve as retaining means for the decorative elements 43 on said inner chain as may readily be seen on FIG. *2a*.

The decorative element 43 shown in detail on FIGS. *4a* to *4c* includes an upper portion 46 which covers entirely the inner chain and two lateral portions 47 and 48 which cover respectively the lateral sides 44 and 45 of the chain. In the particular example of the second embodiment, each lateral portion 47 and 48 is provided with a bore 49 and 50 traversing said lateral portion, in which bore penetrates one of the ends of the pin 38 as may be readily seen on FIG. *2a*. In order to assemble the bracelet, one interlaces two inner links on which one places a decorative element after which one may introduce the pin into the aligned holes.

This second embodiment is by no means limited to the utilization of an inner chain having links formed from a solid mass, such chain being likewise capable of being formed with links having rolled projections as has been described hereinabove in respect of the first embodiment of the invention, the interest in this second embodiment residing in the piercing arrangement provided in the lateral portions of the decorative element. If this arrangement exhibits the slight difficulty of requiring piercing of the decorative elements, it has however the advantage of positioning with great precision the elements relative to the links of the internal chain, this not being the case with the system having slideways as described hereinabove.

FIG. *2a* further shows how the pin 38 is maintained in place. One may introduce into hole 37 a sleeve 51 provided with a central constriction 52 which will be brought to lodge itself into a groove 53 provided in pin 38. Such an arrangement is already known from Swiss patent document CH-A-235 604.

All that has been mentioned hereinabove concerning materials usable for obtaining the decorative element is likewise valid for the second embodiment.

The two embodiments which have here been described proceed from a common inventive idea as expressed in the claims and which consists in employing each pin composing the bracelet to fulfil at the same time two different functions: an articulation function for the links of the inner chain and a function for retaining decorative elements on said inner chain.

What I claim is:

1. A bracelet comprising:

an inner chain comprising a plurality of articulated links, each of said links having projections along transversal edges with each of said projections having a hole extending therethrough;

a plurality of pins, each having first and second ends, each of said pins extending through the holes of two of said projections to thereby pivotally connect each link to at least one other link; and, a plurality of decorative elements arranged side by side and at least partially surrounding said inner chain, each of said decorative elements having first and second pin receiving portions for receiving said first and second ends of one of said pins, whereby said pins pivotally connect said links and also retain said decorative elements on said inner chain.

2. A bracelet as claimed in claim 1 wherein each of said decorative elements includes an upper portion and first and second lateral portions, said first and second pin receiving portions comprising first and second slideways in said first and second lateral portions, respectively.

3. A bracelet as claimed in claim 1 wherein each of said decorative elements includes an upper portion and first and second lateral portions, said first and second pin receiving portions comprising first and second bores extending through said first and second lateral portions, respectively.

4. A bracelet as claimed in claim 1 wherein said decorative elements comprise a ceramic material.

5. A bracelet as claimed in claim 1 wherein said decorative elements comprise a hard metal.

6. A bracelet as claimed in claim 1 wherein each of said decorative elements has a first or a second color, said decorative elements being arranged on said inner chain so that each decorative element of said first color lies between decorative elements of said second color.

7. A bracelet as claimed in claim 1 wherein each of said links comprises a flat strip and each of said projections is a knuckle comprising an extension of one of said links rolled to form said hole.

8. A bracelet as claimed in claim 1 wherein each of said projections comprises a solid mass surrounding said hole.

* * * * *